US005932040A

United States Patent [19]

Audisio

[11] Patent Number: 5,932,040

[45] Date of Patent: Aug. 3, 1999

[54] METHOD FOR PRODUCING A RING OF ABRASIVE ELEMENTS FROM WHICH TO FORM A ROTARY BRUSH

[75] Inventor: Riccardo Audisio, Fossano, Italy

[73] Assignee: Bibielle S.p.A., Italy

[21] Appl. No.: 08/944,007

[22] Filed: Oct. 1, 1997

[51] Int. Cl.[6] ..... B24D 9/00

[52] U.S. Cl. ..... 156/72; 156/213; 156/215; 156/297; 51/293

[58] Field of Search ..... 156/72, 196, 212, 156/213, 214, 215, 297; 451/174; 51/293

[56] References Cited

U.S. PATENT DOCUMENTS 4,448,590 5/1984 Wray et al. .

4,969,299 11/1990 Block .

5,306,319 4/1994 Krishnan et al. .

*Primary Examiner*—Sam Chuan Yao

*Attorney, Agent, or Firm*—Alan H. Gordon

[57] ABSTRACT

A method and system whereby an abrasive ring having an axis and a given number of abrasive sheet elements projecting with respect to the axis is formed by forming an orderly first pack of abrasive sheet elements having a first number of elements smaller than the given number of the ring; forming at least a second pack of elements having a second number of elements at most equal to the difference between the given number and the first number; curving the first pack to form a base ring; circumferentially compacting the elements in the base ring to form at least one gap; and inserting at least a second pack of elements inside the gap.

9 Claims, 4 Drawing Sheets

METHOD FOR PRODUCING A RING OF ABRASIVE ELEMENTS FROM WHICH TO FORM A ROTARY BRUSH

BACKGROUND OF THE INVENTION

The present invention relates to a method of producing a ring of abrasive elements from which to form a rotary brush, in particular a brush comprising a central hub and a ring of abrasive sheet elements substantially projecting from and connected integrally to the hub.

Rings of abrasive elements of brushes of the above type are known, from Italian Patent n. 219581 filed on Feb. 23, 1990 by the present Applicant, to be formed by successively forming a number of abrasive sheet elements from reels of abrasive material in strip form, so as to form a row of side by side, equioriented sheet elements; and subsequently arranging the sheet elements in a ring about the hub, prior to connecting the sheet elements to the hub.

The sheet elements are normally arranged manually about the hub using forming jigs associated with the hub and for ensuring uniform distribution of the sheet elements.

Though used, the above known method is fairly unsatisfactory, by failing to provide for high output rates, and therefore only being suitable for small-scale production, and by failing to ensure consistent quality of the finished brushes. That is, in the interim between being arranged about and actually connected to the hub, one or more of the sheet elements may slip with respect to the others, thus resulting in loss of symmetry and impaired efficiency of the finished brush.

Moreover, the above known method is fairly expensive, by involving the use of skilled labour, and specially designed forming tools or fixtures according to the type of brush being produced.

SUMMARY OF THE INVENTION

It is an object of the present invention to provide a straightforward, low-cost method of producing rotary abrasive brushes, designed to overcome the aforementioned drawbacks.

According to the present invention, there is provided a method of producing a ring of abrasive sheet elements from which to form a rotary brush comprising an axis, and an abrasive ring in turn comprising a given number of abrasive sheet elements substantially projecting with respect to said axis; the method comprising the steps of forming an orderly succession of abrasive sheet elements, and being characterized by comprising the further steps of forming a first orderly pack of said abrasive sheet elements comprising a first number of elements smaller than said given number; forming at least a second pack of said elements comprising a second number of elements at most equal to the difference between said given number and said first number; forming a base ring by curving said first pack; circumferentially compacting the elements in said base ring so as to form at least one gap; and inserting at least a said second pack inside said gap.

The present invention also relates to a system for producing a ring of abrasive sheet elements from which to form a rotary brush.

According to the present invention, there is provided a system for producing a ring of abrasive sheet elements from which to form a rotary brush comprising an axis, and an abrasive ring in turn comprising a given number of abrasive sheet elements substantially projecting with respect to said axis; the system comprising first forming means for forming an orderly succession of abrasive sheet elements, and being characterized by comprising second forming means for forming a first orderly pack of said abrasive sheet elements comprising a first number of elements smaller than said given number; third forming means for forming at least a second pack of said elements comprising a second number of elements at most equal to the difference between said given number and said first number; curving means for curving said first pack and forming a base ring; and compacting means for circumferentially compacting the elements in said base ring so as to form at least one gap for receiving at least a said second pack.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
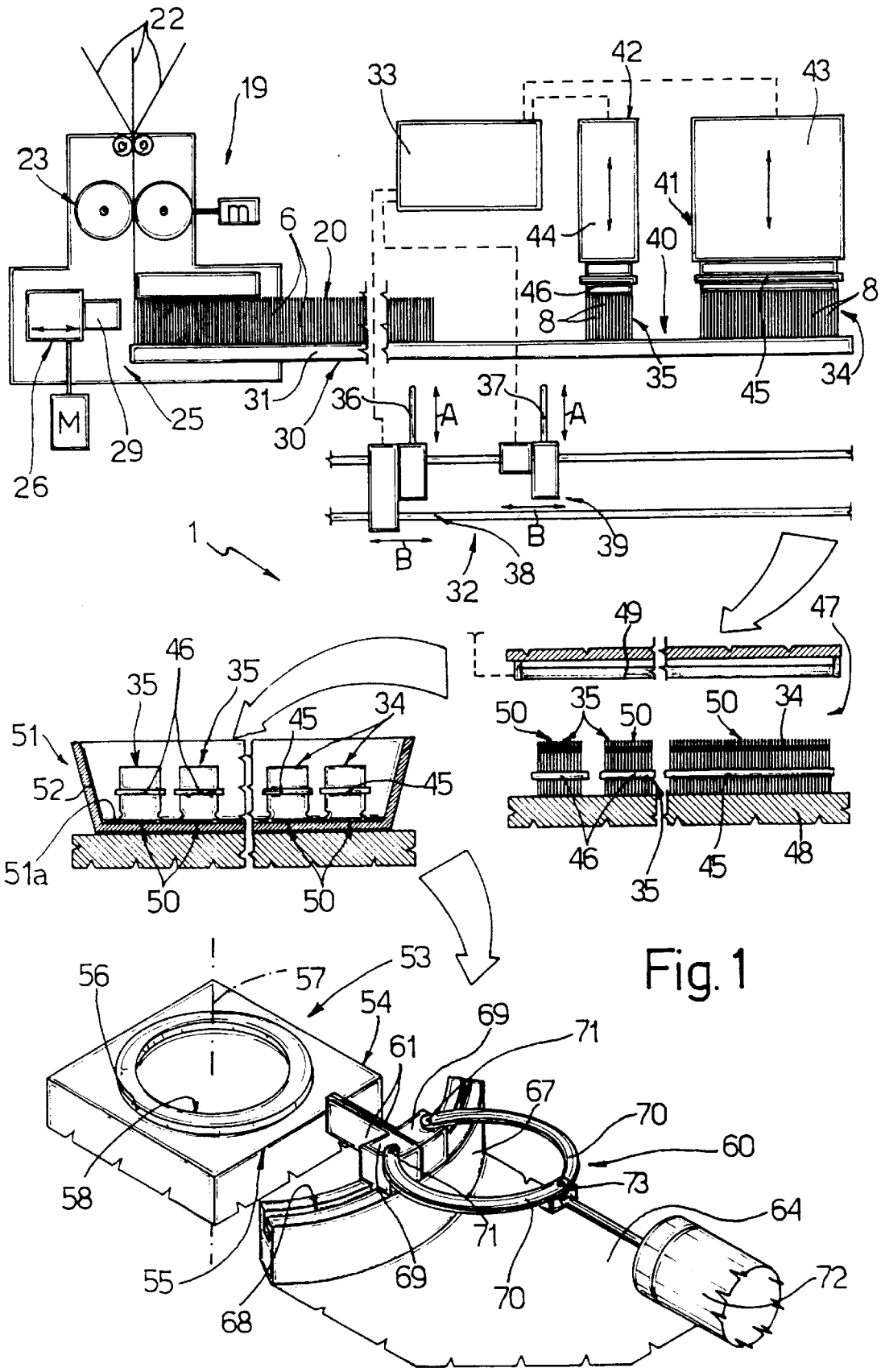
FIG. 1 shows a partial, schematic view of the main components of a preferred embodiment of a system for producing rings of abrasive elements in accordance with the present invention.
Figure 6:
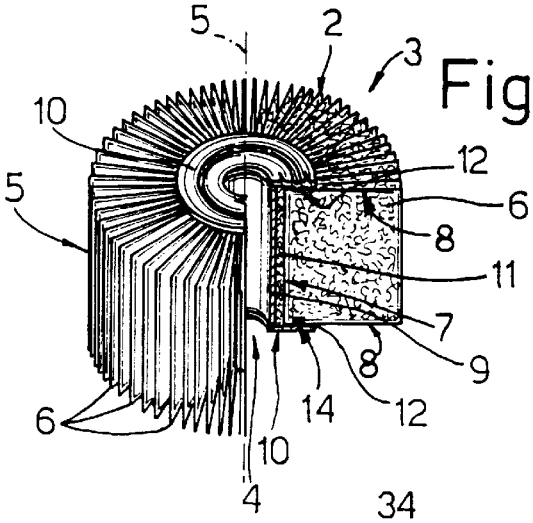
FIGS. 6 and 7 show partially sectioned views in perspective of two different rotary abrasive brushes formed using the FIG. 1 system.
Figure 7:
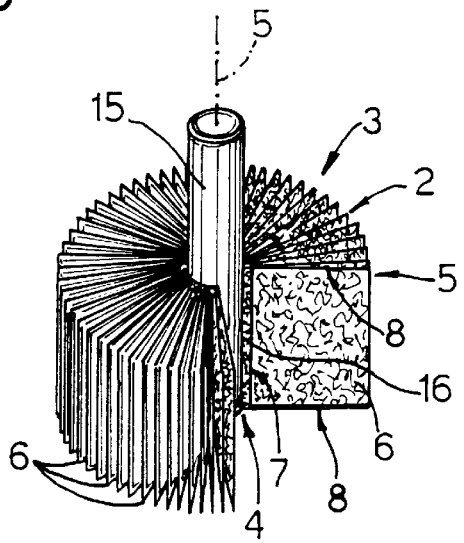

Number 1 in FIG. 1 indicates a system for producing abrasive rings 2 from which to form rotary brushes 3, each of which, as shown in FIGS. 6 and 7, comprises, in addition to respective ring 2, a central hub 4 having a respective axis 5. Each ring 2 comprises a given N number of known abrasive sheet elements 6, each of which substantially extends from hub 4, and has a first axial edge 7 adjacent to the generating line of and connected integrally to hub 4, and two second radial edges 8 extending perpendicularly to edge 7 and axis 5 of hub 4.

As shown in FIG. 6, hub 4 is hollow, and comprises a cylindrical tubular body 9 coaxial with axis 5 and extending loosely inside ring 2, and two disk-shaped bodies or flanges 10 perpendicular to axis 5 at opposite axial ends of ring 2 and body 9, and which define, together with body 9 and ring 2, a cavity filled completely with polymerized adhesive material 11. Each disk-shaped body 10 comprises a peripheral annular rib 12 facing the rib 12 of the other disk-shaped body 10, and which engages a respective circumferential groove formed on a respective face of ring 2 and defined by a number of notches 14 formed in respective edges 8 of elements 6.

Alternatively, as shown in FIG. 7, hub 4 is solid, and comprises a pin 15 coaxial with axis 5 and partly embedded in a block 16 of polymerized adhesive material.

As shown in FIG. 1, system 1 comprises an assembly 19 for forming an orderly succession 20 of sheet elements 6, and of the type described and illustrated in Italian Patent Application n. 219581 filed on Feb. 23, 1990 by the present Applicant, and to which full reference is made herein as required in the interest of full disclosure.

More specifically, assembly 19 comprises an unwinding station (not shown) housing a number of reels of abrasive strip 22 and a powered feed device 23 for unwinding the reels and feeding strips 22 in steps to a cutting station 25.

Cutting station 25 houses known shears 26 for cutting strips 22 transversely into a number of elements 6 with or without notches 14, and which comprise a movable member 29 for successively feeding elements 6 to a straight guide 30 comprising, in the example shown, two spaced, parallel, facing L-shaped sections 31 (only one shown in FIG. 1).

Guide 30 is provided with an adjustable separating device 32 controlled by a known central control unit 33 to divide succession 20 into a first series of packs 34, each comprising an N1 number of elements 6 smaller than the N number of ring 2, and a second series of packs 35, each comprising a variable N2 number of elements 6 at most equal to the difference between the N number of elements 6 in ring 2 and the N1 number of elements 6 in packs 34.

In the embodiment described, separating device 32 comprises two powered blade members 36 and 37 connected to respective known actuating assemblies 38 and 39 (not described in detail), which provide for moving respective members 36 and 37 to and from guide 30 in respective substantially vertical directions A, and in respective directions B parallel to guide 30.

As shown in FIG. 1, guide 30 extends through a retaining station 40 for retaining elements 6 defining packs 34, 35, and which houses two push devices 41 and 42 controlled by central unit 33 and comprising respective actuating members 43 and 44, which are movable to and from guide 30 in respective directions parallel to directions A to fit respective elastic retaining rings 45 and 46 onto each of respective packs 34 and 35. More specifically, retaining rings 45, 46 are fitted to respective packs 34, 35 on intermediate portions of edges 8 of elements 6.

Downstream from station 40 in the traveling direction of elements 6, system 1 comprises a preheating station 47 housing a horizontal surface 48 supporting packs 34, 35, and a known, e.g. infrared ray, heat source 49 facing surface 48 to heat respective lateral surfaces 50 of packs 34, 35 defined by edges 7 of respective elements 6.

As shown in FIG. 1, downstream from station 47 in the traveling direction of elements 6, system 1 comprises a prebonding station 51 for prebonding elements 6, and where a layer of adhesive material 51*a* is deposited at least on surfaces 50 of packs 34, 35. More specifically, station 51 houses a tank 52 containing a layer of liquid adhesive material 51*a* varying in thickness according to the size of elements 6 and normally ranging between 3 and 4 millimeters. In the example described, adhesive material 51*a* comprises a two-component epoxy resin conveniently selected from resins known commercially as "DER 352" or "DER 331", both produced by Dow Chemical; and a hardening agent selected from those known commercially as "CHEMAMMINA P31" produced by Chem-Plast S.p.A., or "ANCAMIDE 260A" produced by Anchor Italiana S.p.A.

Figure 3:
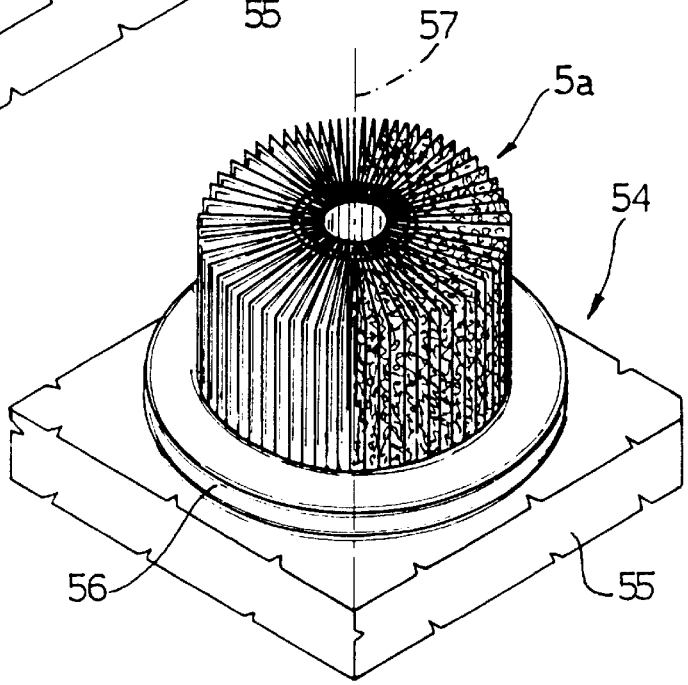

On leaving station 51, packs 34 are fed successively to a curving station 53, where they are curved in known manner by respective forming devices 54 (only one shown in FIG. 1) to form respective rings 5*a* (FIG. 3), which differ from rings 2 by simply comprising a smaller number of elements 6.

Figure 2:
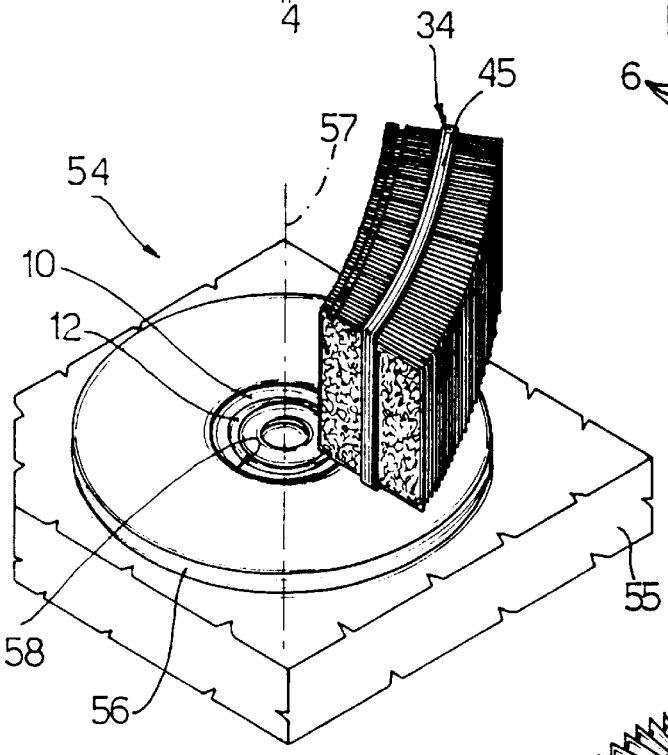
FIGS. 2 and 3 show larger-scale schematic views in perspective of two embodiments of a detail in FIG. 1.

Each device 54 comprises a fixed frame 55; and a forming platform 56 fitted in axially-fixed manner to frame 55 so as to rotate about a vertical axis 57. Platform 56 comprises a circular guide defined by a circular retaining seat 58 (FIG. 1), which is open at the top, is coaxial with axis 57, and, in the case of a ring 5*a* from which to form a brush 3 with a solid hub (FIG. 3), partially houses ring 5*a* and retains elements 6 in fixed radial positions. Conversely, in the case of a ring 5*a* from which to form a brush 3 with a hollow hub, seat 58 houses one of bodies 10 (FIG. 2), the rib 12 of which defines a guide and a retaining element for positioning and retaining elements 6.

Station 53 also houses a parting assembly 60 for circumferentially moving and compacting elements 6 of ring 5*a* on platform 56.

Figure 4:
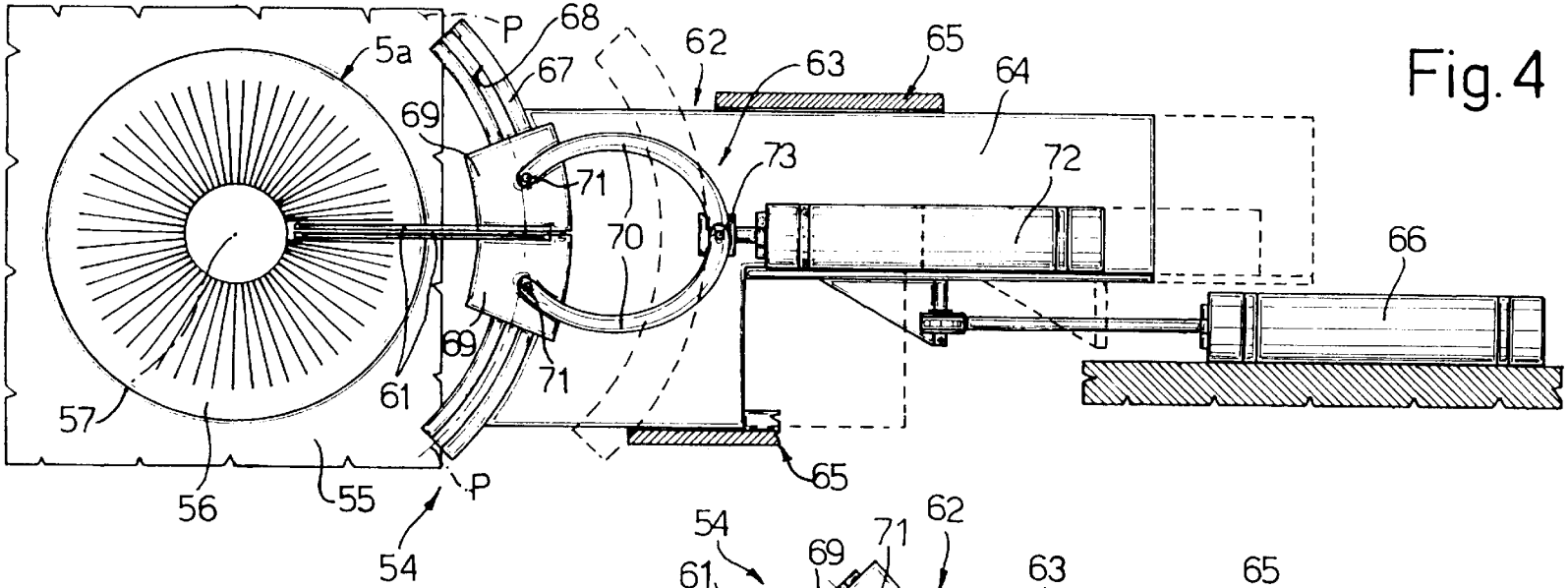
FIGS. 4 and 5 show larger-scale views of a further FIG. 1 detail in two different operating positions.
Figure 5:
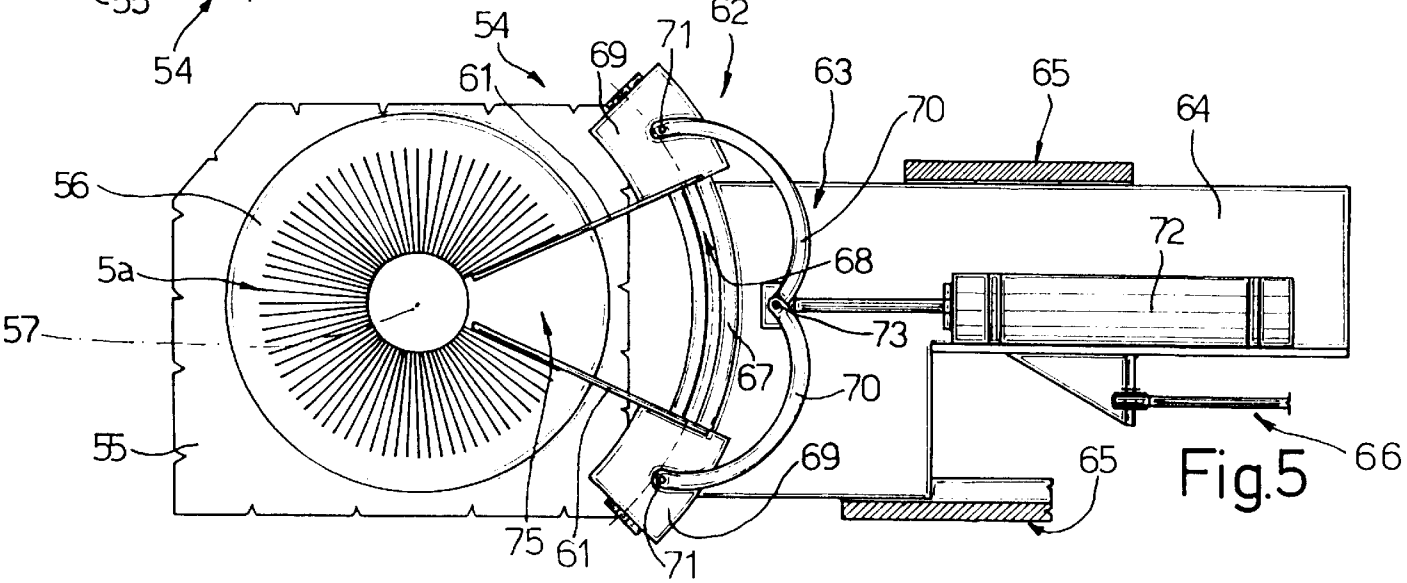

As shown particularly in FIGS. 4 and 5, assembly 60 comprises a pair of blades 61 positioned on edge and extending radially with respect to axis 57; an actuating and guide device 62 for moving blades 61 to and from platform 56, and guiding blades 61 along respective circular paths P; and an actuating device 63 for moving blades 61 in opposite directions along paths P.

More specifically, device 62 comprises a frame 64 fitted in sliding manner to a respective fixed guide 65, and which is movable, in a direction perpendicular to axis 57 and by a linear actuator 66, between a withdrawn rest position in which blades 61 extend outside ring 5*a*, and a forward operating position (FIGS. 4 and 5) in which blades 61 extend partly between two adjacent elements 6 of ring 5*a*. Frame 64 supports a guide body 67 comprising a circular groove 68, which extends coaxially with axis 57 when frame 64 is in the operating position, and which is engaged in sliding manner by two slides 69, each supporting a respective projecting blade 61. Slides 69 are moved in opposite directions along groove 68 by device 63, which comprises a pair of curved arms 70, in turn comprising respective end portions hinged to respective slides 69 so as to rotate about respective hinge pins 71 parallel to axis 57, and respective opposite end portions hinged to each other and to the output rod of a linear actuator 72 fitted to frame 64 by a single hinge pin 73 parallel to pins 71.

Operation of system 1 will now be described with reference, for the sake of simplicity, to the formation of one ring 2, and as of the condition in which a succession 20 of elements 6 is engaged by guide 30, blades 36 and 37 are both in the lowered rest position outwards of guide 30 (FIG. 1), frame 64 is in the withdrawn position, and blades 61 are positioned contacting each other.

As of the above condition, blades 36 and 37 are first positioned at a distance from each other equal to the length of pack 34, are then raised and inserted between elements 6 in succession 20 to isolate N1 number of elements 6, and are then transferred together to station 40, where elements 6 gripped between blades 36 and 37 and defining pack 34 are positioned beneath device 41, movable element 43 of device 41 is moved towards pack 34, and a retaining ring 45 is fitted onto pack 34 to retain elements 6 in fixed mutual positions.

At this point, pack 34 complete with retaining ring 45 is fed to station 47 and positioned on surface 48 with surface 50 facing heat source 49; pack 34 is kept in station 47 for as long as it takes to bring surface 50 to a given prebonding temperature varying according to the characteristics of adhesive material 51*a*, at which point, pack 34 is turned over by a known manipulator (not shown), and surface 50 is immersed in adhesive material 51*a*; surface 50 remains immersed in adhesive material 51*a* for a given impregnating time varying according to the material of elements 6, at which point, pack 34 is removed from tank 52 and transferred to station 53, where it is placed on platform 56, is gradually freed from retaining ring 45, and is curved so that the layer of adhesive material 51*a* extends inside the ring being formed. At station 53, the curving of pack 34 is assisted by seat 58 and/or rib 12 of body 10, which provide for both guiding elements 6 along a circular path and for retaining elements 6, which, once curved, are partially housed inside seat 58 and/or connected to rib 12.

At this point, actuator 66 moves frame 64 into the forward position to insert blades 61 between two adjacent elements 6 of ring 5*a*; and actuator 72 is activated to move and part slides 69, by means of arms 70, in opposite directions along groove 68, and so part blades 61, which move and compact elements 6 circumferentially to form a gap 75 inside seat 58 (FIG. 5).

At this point, gap 75 is filled by inserting one or more packs 35 removed from tank 52 and formed in the same way as packs 34. More specifically, each pack 35 is formed by removing N2 number of elements 6 from succession 20 by means of blades 36 and 37, fitting a retaining ring 46 onto pack 35 by means of device 42, and feeding the pack 35 so formed to station 51 following the same procedure described for pack 34. Once pack 35 is inserted, blades 61 are withdrawn from the ring by simultaneously activating actuators 66 and 72.

If the elements 6 of the resulting ring are sufficiently compacted, i.e. are equal in number to said given number N, the finished ring is inserted inside an annular retaining body (not shown), and is transferred from station 53—possibly via a centrifugal balancing station (not shown)—to a bonding station (not shown) where ring 2 is bonded to hub 4.

Conversely, if the resulting ring is not sufficiently compacted, it is either maintained in the same angular position with respect to frame 55 or, preferably, rotated together with platform 56 about axis 57, and further packs not necessarily the same as pack 35 are inserted inside the ring in the same way as described for pack 35.

In addition to superior quality and performance spanning substantially the whole of their working life, the brushes 3 comprising rings 2 formed using system 1 therefore also have the undisputed advantage of all being of the same quality and performance standard, and being relatively cheap to produce.

That is, the mutual position of elements 6 of each ring 2 is guaranteed, prior to curving and inserting packs 34 and 35, by guide 30, by retaining rings 45 and 46 fitted to respective packs 34 and 35, and by prebonding adhesive material 51*a* deposited on surfaces 50 of packs 34 and 35, and, during formation of ring 2, by adhesive material 51*a*, which at this point defines a virtual hinge preventing any slippage of adjacent elements 6, by retaining rings 45 and 46, and by seat 58 or rib 12 of body 10 housed inside seat 58.

Moreover, elements 6 in each ring 2 are locked in position and gripped with respect to one another by the compacting action of blades 61 and by insertion of pack/s 35 between two or more elements 6 of respective pack 34.

In terms of construction and operation, system 1 comprises relatively straightforward components, and is therefore fairly cheap to produce and requires no skilled labour.

Clearly, changes may be made to system 1 as described and illustrated herein without, however, departing from the scope of the present invention.

Figure 8:
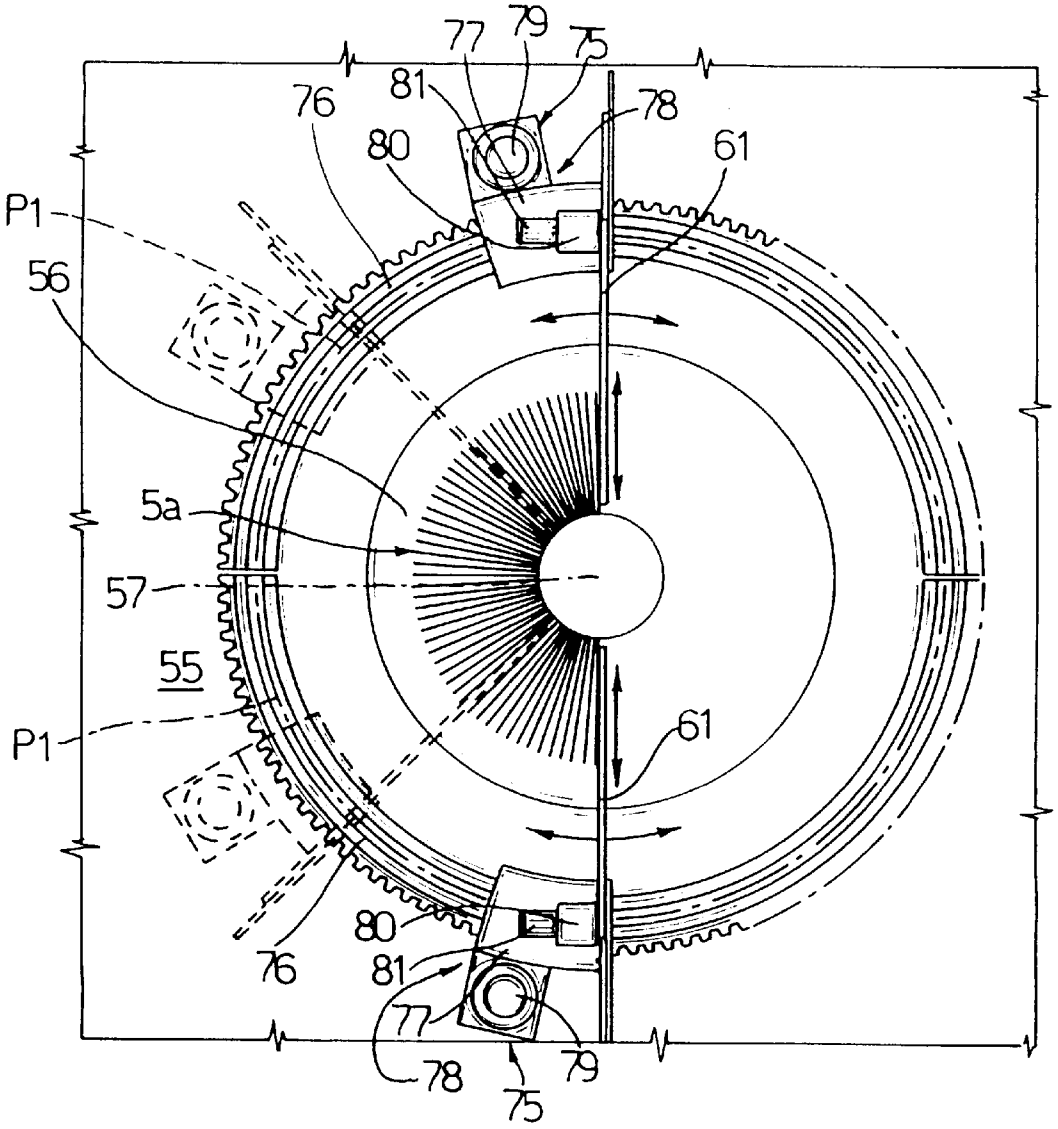
FIG. 8 shows a schematic view of a variation of a detail in FIG. 5.

In particular, packs 34 and 35 may be formed otherwise than as described by way of example, and may comprise any number of sheet elements 6 smaller than the N number of ring 2. Also, parting assembly 60 may differ from the embodiment described and be of the type shown, for example, schematically in FIG. 8, in which blades 61 are moved in opposite directions along respective circular paths P1 coaxial with axis 57 by respective actuating assemblies 75 synchronized by a known central control unit not shown. Preferably, each actuating assembly 75 comprises a fixed guide 76 extending along respective path P1; and a slide 77 moved along guide 76 by a known, preferably gear, transmission 78 powered by an electric motor 79 controlled by said central control unit.

Each slide 77 is fitted with a further slide 80, which in turn is fitted integrally with a respective blade 61, and is moved in a radial direction to and from axis 57 by a respective electric motor 81 also controlled by said central control unit (not shown).

According to an alternative variation not shown, assemblies 75 are replaced by one or more known pneumatic actuating assemblies.

Also, devices 41 and 42 of system 1 may be dispensed with, and retaining rings 45 and 46 assembled manually.

Finally, different devices may be provided for depositing prebonding adhesive material 51*a* on surfaces 50; and preheating station 47 for preheating surfaces 50 may be dispensed with.

I claim:

1. A method of producing a ring of abrasive sheet elements from which to form a rotary brush having an axis and an abrasive ring where the abrasive ring includes a given number (N) of abrasive sheet elements substantially projecting with respect to said axis, the method comprising the steps of;

a) forming an orderly succession of abrasive sheet elements;

b) forming a first orderly pack of said abrasive sheet elements comprising a first number (N1) of elements smaller than said given number (N);

c) forming at least a second pack of said elements comprising a second number (N2) of elements at most equal to the difference between said given number (N) and said first number (N1);

d) forming a base ring by curving said first pack;

e) circumferentially compacting the elements in said base ring so as to form at least one gap; and f) inserting at least a said second pack inside said gap.

2. The method of claim 1, wherein said elements are so compacted circumferentially as to form at least two said gaps separated circumferentially and wherein at least one said second pack is inserted inside each of said gaps.

3. The method of claim 1, wherein said base ring is formed by curving said first pack in contact with a circular guide.

4. The method of claim 3, wherein said compacting is performed by moving at least some of said elements along said circular guide and wherein said second packs are inserted by connecting the elements of the second packs to said circular guide.

5. The method of claim 1, further comprising the step of: depositing a layer of elastic adhesive material on a lateral surface of at least said first pack of elements prior to curving the first pack to form said base ring.

6. The method of claim 5, wherein said layer of adhesive material is also deposited on a lateral surface of said second pack prior to inserting the second pack inside said gap.

7. The method of claim 5, wherein said layer of adhesive material is formed by partially immersing said packs in a tank of said adhesive material.

8. The method of claim 5, further comprising the step of preheating a lateral surface of said pack prior to depositing said layer of adhesive material on the lateral surface.

9. The method of claim 1, further comprising the step of fitting each pack with at least an elastic retaining element for maintaining the elements of said packs in fixed mutual position following the formation of said packs.

* * * * *